United States Patent [19]

Halverson

[11] Patent Number: 4,737,999

[45] Date of Patent: Apr. 19, 1988

[54] MATERNITY MATTRESS

[75] Inventor: Debra A. Halverson, Hillsborough Township, Somerset County, N.J.

[73] Assignee: Jabiru Incorporated, Flagtown, N.J.

[21] Appl. No.: 9,810

[22] Filed: Feb. 2, 1987

[51] Int. Cl.[4] ..... A47C 27/10

[52] U.S. Cl. ..... 5/455; 5/464

[58] Field of Search ..... 5/455, 465, 431, 449, 5/441, 464, 434, 435, 436

[56] References Cited

U.S. PATENT DOCUMENTS

| | | | |
|---|---|---|---|
| 1,576,211 | 3/1926 | O'Kane | 5/455 |
| 2,491,557 | 12/1949 | Goolsbre | 5/455 |
| 2,582,439 | 1/1952 | Kavanagm | 5/455 |
| 3,276,046 | 10/1966 | Capelli | 5/436 |
| 3,303,518 | 2/1967 | Ingram | 5/456 |
| 3,840,920 | 10/1974 | Voelker | 5/455 |
| 4,051,566 | 10/1977 | Esquivel | 5/446 |
| 4,054,960 | 10/1977 | Pettiit et al. | 5/435 |
| 4,428,087 | 1/1984 | Horn | 5/455 |
| 4,489,452 | 12/1984 | Lickert | 5/455 |
| 4,617,690 | 10/1986 | Grebe | 5/455 |

FOREIGN PATENT DOCUMENTS

| | | | |
|---|---|---|---|
| 1202100 | 1/1960 | France | 5/455 |

*Primary Examiner*—Alexander Grosz

*Attorney, Agent, or Firm*—Kenneth P. Glynn

[57] ABSTRACT

The present invention is directed to a mattress for pregnant women which has a main mattress section of the conventional configuration, but with an opening therein for serial, adjustable cushions for abdominal support. A plurality of inflatable and deflatable cushions are serially arranged within one another and are located within the opening of the main mattress section. In a preferred embodiment, the mattress has a plurality of inflatable cushions which are segmented or cut in half so as to have upper half and lower half sections. In addition, a preferred embodiment includes cushion sections at least some of which have a height which is in excess of the height of the main mattress section.

23 Claims, 4 Drawing Sheets

MATERNITY MATTRESS

BACKGROUND OF THE INVENTION

1. Field of the Invention

The present invention relates to mattresses and, more particularly, to mattresses for supporting pregnant women wherein a plurality of physiological needs which are peculiar to pregnant women are satisfied.

2. Prior Art Statement

Air mattresses are well known and have been in existence for a number of decades. Typically, air mattresses are made up of a plurality of channels or chambers which have heat seal-type seams and with plastic or plasticized canvas-type material whereby the typical air mattress has a single inflation nozzle and the air is blown into the air mattress so as to inflate all of the chambers. In 1984, U.S. Pat. No. 4,428,087 issued to Friedrich Horn and was directed to a therapeutical air mattress. In this particular air mattress, there was an inflatable hollow body provided with a pair of symmetrically arranged longitudinal air tubes which form an inflatable single chamber system and which almost adjoin one another in a head region and were spaced from one another in a body region so as to satisfy the particular needs of a patient lying in the mattress in such a manner that the mattress could be set in rhythmical vibrations. Typically, this therapeutical air mattress was used to treat people with articluar rheumatism and/or with blockages of the vertebrae and articulations.

In addition to the general state of the art of air mattresses, some patents have issued which are directed to mattresses designed specifically for pregnant women. Thus, U.S. Pat. No. 3,840,920 issued on Oct. 15, 1974 to Walter Voelker was directed to an adjustable mattress for pregnant mothers wherein separate compartments were provided in the design with each compartment containing non-resilient flowable material. More specifically, various types of cellular material as well as other choice materials listed in the patent would be used in conjunction with spheres which operated in a thixotropic fashion. The particular structure described in this patent was to be divided into separate chambers including one located in the general enlarged abdominal area of the pregnant woman whereby different flowability characteristics of the flowable material could be maintained or, in the alternative, the flowability of the flowable material in each compartment was continuously or intermittently altered by altering the volume of the envelope, either mechanically or by altering gas pressure or liquid pressure in the compartment, thus causing the slightly elastic envelope to increase or decrease in volume.

U.S. Pat. No. 4,051,566 issued on Oct. 4, 1977 to Lucy Esquivel was directed to a mattress with a modifiable cavity for pregnant women. Basically, this patent teaches a mattress structure which has an insert in a cavity which is movably mounted so that it may be raised or lowered to accommodate a woman who is pregnant in such a fashion that she may lay on the mattress face down with her abdomen in the cavity. Specifically, a hand crank is provided whereby the cavity section with the insert may be cranked so that the insert may be raised or lowered.

U.S. Pat. No. 4,489,452 is directed to a prenatal mattress and issued on Dec. 25, 1984 to Jodey Lickert. This patent describes a prenatal mattress enabling a pregnant woman to lie more comfortably and safely on her abdomen during the pregnancy term. The mattress comprises a lower layer of cloth carrying releasable fasteners, a fluid-fillable abdominal cushion, and a fluid-fillable head cushion. An upper layer of cloth is provided so as to seal the cushion and headrest in place. The cushions can be filled to the extent desired with a fluid, placed between the areas and the fasteners can be attached so as to form the mattress. In a preferred embodiment, the cushion has dual indentations to accommodate the breasts of the pregnant woman and a lower indentation to accommodate the thighs or upper leg areas.

Notwithstanding all of the prior art, there appears to be no patent or reference which teaches or renders obvious some of the critical features of the present invention which includes a plurality of concentric cushions, each being independently inflatable, which are designed to take into consideration different size enlarged abdomens of pregnant women, different size breases, different size thighs, and different relative locations among these body parts as well as consideration for the needs of other body parts.

Thus, the prior art is believed to establish the state of the art and to establish the patentability of the present invention.

SUMMARY OF THE INVENTION

The present invention is directed to a mattress for pregnant women which has a main mattress section of the conventional configuration, but with an opening therein for serial, adjustable cushions for abdominal support. A plurality of inflatable and deflatable cushions are serially arranged within one another and are located within the opening of the main mattress section. In a preferred embodiment, the mattress has a plurality of inflatable cushions which are segmented or cut in half so as to have upper half and lower half sections. In addition, a preferred embodiment includes cushion sections at least some of which have a height which is in excess of the height of the main mattress section.

BRIEF DESCRIPTION OF THE DRAWINGS

The present invention will be more fully understood in light of the specification and drawings, wherein.

DETAILED DESCRIPTION OF THE PRESENT INVENTION

Figure 1:
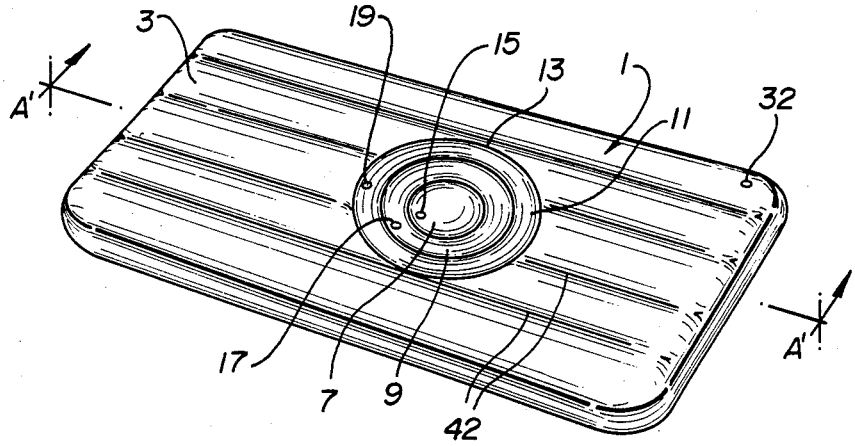
FIG. 1 is a perspective view of a maternity mattress of the present invention showing a plurality of cushions serially arranged within one another.

Mattress 1 for a pregnant woman is shown in FIG. 1 and has a main mattress section 3 of conventional configuration as shown, but has an opening 13 for serial adjustable cushions 7, 9 and 11. As shown, cushion 7 is simply a circular cushion and cushions 9 and 11 are toroidal or doughnut-like in structure. While mattress 1 is shown, in this case, as an inflatable mattress and includes inflation port 32, it should be noted that the mattress may be of any conventional material of construction and design. Thus, it may be an air mattress, a water mattress, a foam mattress, or any other type of conventional mattress material.

Cushions 7, 9 and 11 have inflation ports 15, 17 and 19 respectively as shown. These are arranged in no particular order, except that they should be designed so as to be pushed in and not be an impediment or protrusion which would annoy, irritate or harm the user.

Figure 2:
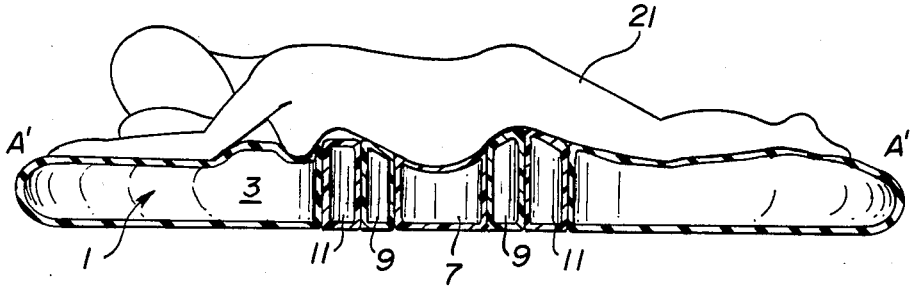
FIG. 2 is a side cut view of the mattress of the present invention shown in FIG. 1, but cut along line A' A', and includes a profile of a pregnant woman utilizing the mattress.

FIG. 2 shows a side cut view of mattress 1 which is shown in FIG. 1 as cut along line A' A'. Also included in FIG. 2 is a side view of pregnant woman 21 lying on her stomach. In this case, pregnant woman 21 is only slightly enlarged in the abdominal area and thus in her early term of pregnancy. Using mattress 1 at this stage of the pregnancy, pregnant woman 21 would let some of the air out of cushion 7 and most probably keep full air in cushions 9 and 11. Thus, as mentioned above, the main mattress section 3 of mattress 1 can be made of any material and may be air, water, or foam or the like, it is essential to the present invention that the adjustable cushions for abdominal support used therein, in this Figure cushions 7, 9 and 11, be inflatable and deflatable, as shown.

Figure 3:
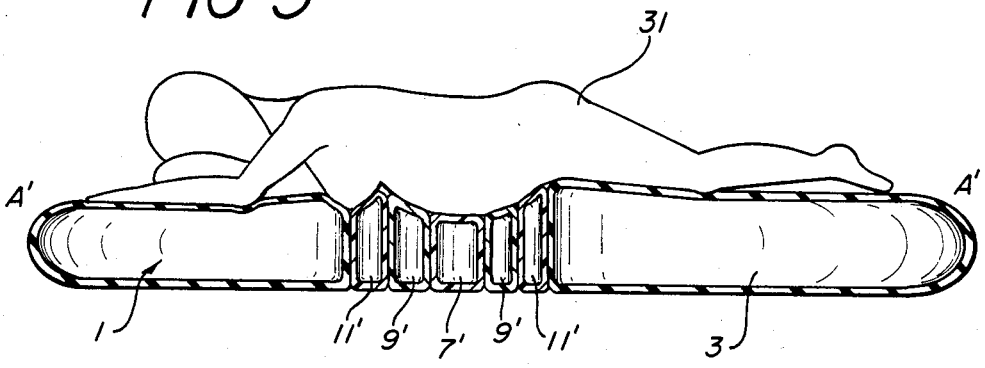
FIG. 3 is a cut side view of the mattress shown in FIG. 1, along line A' A', showing a pregnant woman, but here more fully along in her term.

FIG. 3 shows pregnant woman 31 in about her seventh or eighth month of pregnancy utilizing present invention mattress 1 as shown in a cut side view of mattress 1 and a profile of pregnant woman 31. Therein, a considerable amount of air is deflated from cushion 7, now shown as cushion 7' in its more deflated form, as well as some air from cushions 9 and 11, now shown as cushions 9' and 11'. In this manner, a larger recess is created for the abdominal area and there is some accommodation for enlarged breasts as shown. The serial, adjustable cushions 7, 9 and 11 shown herein are integral parts of mattress 1 and are not removable. Thus, in this particular embodiment, they are heat sealed and integral parts as shown with wall dividers. However, these could be removable or detachably removable as shown and discussed in more detail in conjunction with FIG. 6 below.

Figure 4:
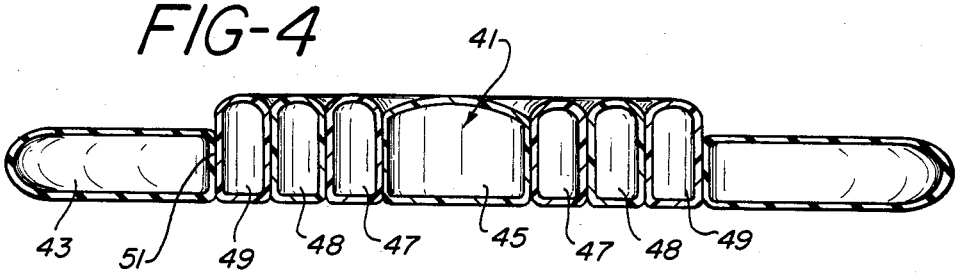
FIG. 4 is a side view of another embodiment of the present invention cut along the vertical midsection thereof.

FIG. 4 shows and alternative embodiment in its cross-section side view wherein the serial, adjustable cushions are designed so as to have a height which is in excess of the height of the mattress itself. Thus, in FIG. 4, present invention mattress 41 is shown having a main mattress section 43 with an opening 51 therein. In this embodiment, a total of four cushions are shown instead of three, although the exact number is not critical, it is important that a plurality of cushions be employed so as to allow significant adjustability. In the present embodiment shown in FIG. 4, central cushion 45 is shown which has around it cushion 47 and around cushion 47 is cushion 48 and around cushion 48 is outermost cushion 49. The inflation ports are not shown.

Figure 5:
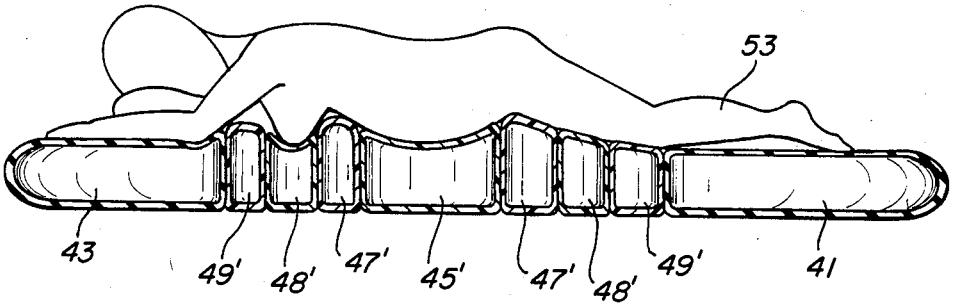
FIG. 5 is a side cut view showing a pregnant woman using the mattress of the present invention shown in FIG. 4.

FIG. 5 shows the mattress shown in FIG. 4, namely, mattress 41, wherein the various cushions are close to fully inflated down to partially inflated as shown. Thus, cushion 45' is substantially deflated, cushion 47' is substantially totally inflated and cushions 48' and 49' are slightly deflated as shown. Thus, the present invention mattress 41 having a pregnant women 53 thereon, is shown so as to accommodate pregnant woman 53's knee, thigh, hip region, enlarged abdomen, lower chest and breasts, and the raised cushions aid to relieve low back pressure. Also, in this embodiment, the cushions are independently removable and not permanently attached so that they may be replaced at a later date by a "dummy" type cushion after the pregnancy is over. While this would be an optional convenience, it would eliminate the necessity of dealing with a plurality of inflation ports after the pregnancy has been completed and the abdominal area is back to normal. On the other hand, the user may wish to retain the plurality of cushions and contour it to fit the non-pregnant body so as to enhance sleeping on the stomach or abdominal area.

Figure 6:
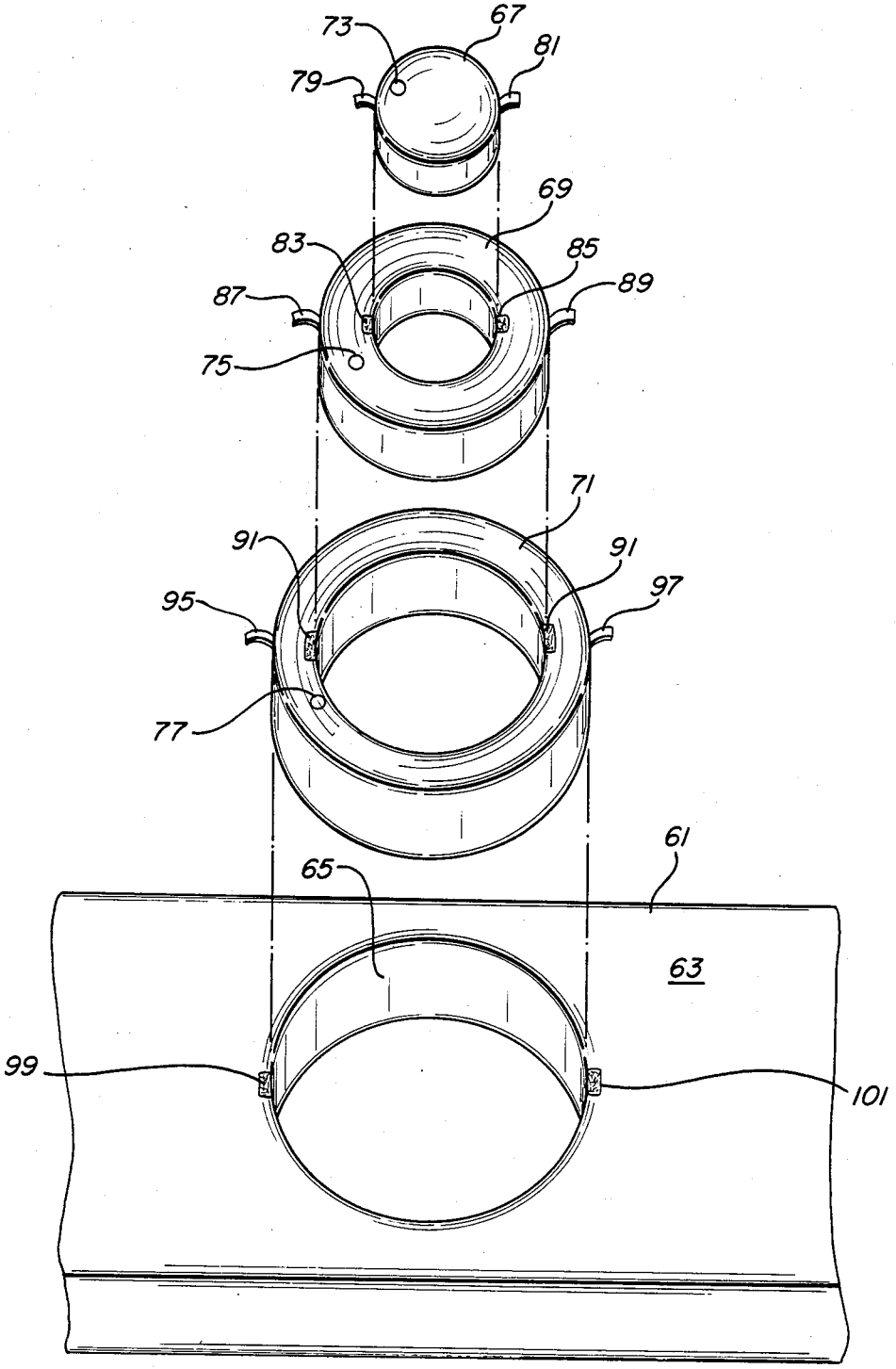
FIG. 6 and 7 show embodiments of the present invention maternity mattress wherein the cushion sections are attachably removable.

FIG. 6 shows a present invention mattress 61 having a conventional main mattress section 63 with an opening 65 shown therein. In this embodiment, three cushions, namely cushions 67, 69, and 71 are removably insertable into opening 65. As shown, cushions 67, 69 and 71 have inflation ports 73, 75 and 77 respectively. Cushion 67 inserts directly and fits snugly into cushion 69 in their fully inflatable state and cushion 67 has VELCRO® flaps 79 and 81 which are attachable to opposite VELCRO® strips 83 and 85 on cushion 69. Likewise, cushion 69 has VELCRO® flaps 87 and 89 which are attachable to VELCRO® strips 91 on cushion 71. Concomitantly, cushion 71 has VELCRO® flaps 95 and 97 which attach to VELCRO® strips 99 and 101 on main mattress section 63. In this manner, each of the cushions are attachable to one another and will not pop out or move around. Obviously, the attachment means are not essential as discussed in conjunction with FIGS. 4 and 5 above, however, they are preferred. Also, it should be noted that, although VELCRO® attachment means are shown, other attachment means such as padded buttons, hooks or any other known attachment means could be used.

Figure 7:
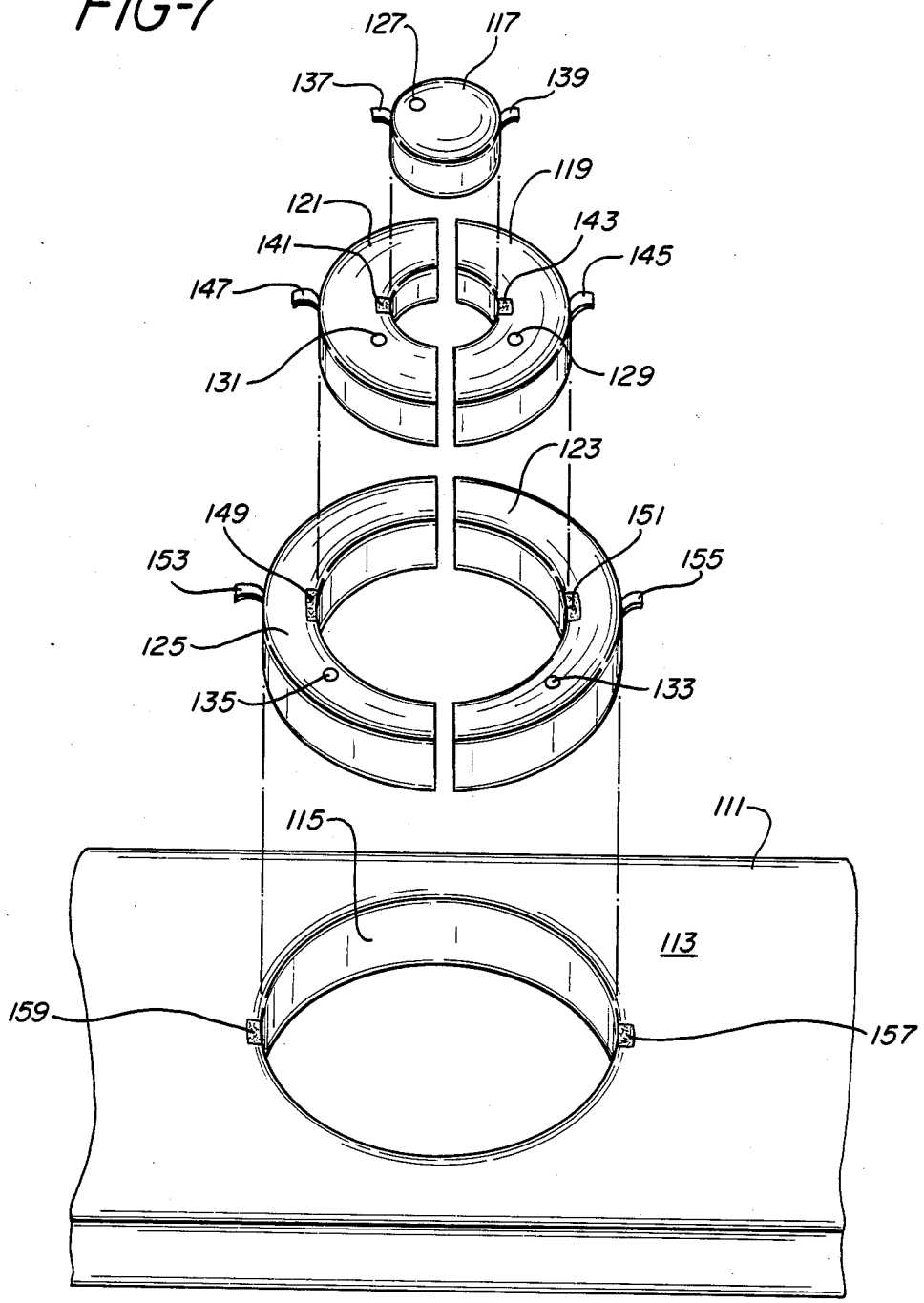

FIG. 7 shows a present invention mattress 111 having a conventional main mattress section 113 with an oval opening 115 shown therein. In this embodiment, five cushions, namely cushion 117 and half cushions 119, 121, 123 and 125 are removably insertable into opening 115. As shown, the cushions have inflation ports 127, 129, 131, 133 and 135 respectively. Cushion 117 inserts directly and fits snugly into half cushions 119 and 121 in their fully inflatable state and cushion 117 has VELCRO® flaps 137 and 139 which are attachable to opposite VELCRO® strips 141 and 143 on cushions 121 and 119 respectively. Likewise, cushions 119 and 121 have VELCRO® flaps 145 and 147 which are attachable to VELCRO® strips 149 and 151 on cushions 125 and 123. Concomitantly, cushions 123 and 125 have VELCRO® flaps 155 and 153 which attach to VELCRO® strips 157 and 159 on main mattress section 113. In this manner, each of the cushions are attachable to one another and, coupled with a snug fit, will not pop out or move around. Obviously, the attachment means could also include VELCRO® strips for attachment to a base (not shown) inside opening 115. Likewise, while the half cushions shown herein are separate pieces, they could comprise full cushions with half cushion compartments to permit similar number of separately adjustable and inflatable areas with the use of fewer separate cushions.

Obviously, numerous modifications and variations of the present invention are possible in light of the above teachings. It is therefore understood that within the scope of the appended claims, the invention may be practiced otherwise than as specifically described herein.

What is claimed is:

1. A mattress for a pregnant woman which comprises:

(a) a main mattress section having an opening for a plurality of toroidal, adjustable cushions for abdominal support; and, (b) a plurality of individually inflatable and deflatable toroidal cushions which are arranged concentrically and are located within said opening of said main mattress section.

2. The mattress of claim 1 wherein said plurality of inflatable cushions are removable.

3. The mattress of claim 2 wherein said cushions are inserted into said opening of said main mattress section by merely being placed therein.

4. The mattress of claim 1 wherein said plurality of inflatable cushions are removably attached to said mattress at the opening of said main mattress section.

5. The mattress of claim 1 wherein said plurality of inflatable cushions are permanently attached to the main mattress section.

6. The mattress of claim 1 wherein the main mattress section is inflatable and has a series of seams so as to create a row of inflatable tubes interconnected to one another.

7. The mattress of claim 1 wherein said main mattress section is inflatable and has a series of segmented rows of tubular sections which are not interconnected and are separately inflatable.

8. The mattress of claim 1 wherein said plurality of toroidal cushions are oval in shape.

9. A mattress for a pregnant woman which comprises:

(a) a main mattress section having an opening for a plurality of toroidal, adjustable cushions for abdominal support; and, (b) a plurality of inflatable and deflatable toroidal cushions which are arranged concentrically and are located within said opening of said main mattress section, and wherein at least a portion of said plurality of inflatable cushions have a height which is in excess of the height of the main mattress section.

10. The mattress of claim 9 wherein said plurality of inflatable cushions are removable.

11. The mattress of claim 10 wherein said cushions are inserted into said opening of said mattress section by merely being placed therein.

12. The mattress of claim 9 wherein said plurality of inflatable cushions are removably attached to said mattress at the opening of said main mattress section.

13. The mattress of claim 9 wherein said plurality of inflatable cushions are permanently attached to the main mattress section.

14. The mattress of claim 9 whreein the main mattress section is inflatable and has a series of seams so as to create a row of inflatable tubes interconnected to one another.

15. The mattress of claim 9 wherein said main mattress section is inflatable and has a series of segmented rows of tubular sections which are not interconnected and are separately inflatable.

16. The mattress of claim 9 wherein said plurality of toroidal cushions are oval in shape.

17. The mattress of claim 9 wherein said plurality of cushions are each in the shape of a half toroid.

18. A mattress for a pregnant woman which comprises:

(a) a main mattress section having an opening for a plurality of toroidal, adjustable cushions for abdominal support; and, (b) a plurality of individually inflatable and deflatable toroidal cushions which are arranged concentrically and are located within said opening of said main mattress section and said cushions are removable.

19. The mattress of claim 18 wherein said cushions are inserted into said opening of said main mattress section by merely being placed therein.

20. The mattress of claim 18 wherein said plurality of inflatable cushions are removably attached to said mattress at the opening of said main mattress section.

21. The mattress of claim 18 wherein the main mattress section is inflatable and has a series of seams so as to create a row of inflatable tubes interconnected to one another.

22. The mattress of claim 18 wherein said main mattress section is inflatable and has a series of segmented rows of tubular sections which are not interconnected and are separately inflatable.

23. The mattress of claim 18 wherein said plurality of toroidal cushions are oval in shape.

* * * * *